United States Patent [19]

Kato et al.

[11] Patent Number: 4,842,818

[45] Date of Patent: Jun. 27, 1989

[54] METHOD FOR MANUFACTURING TAPERED RODS

[75] Inventors: Tetsuo Kato, Nagoya; Shozo Abeyama, Aichi; Makoto Saito, Nagoya, all of Japan

[73] Assignee: Daido Tokushuko Kabushiki Kaisha, Aichi, Japan

[21] Appl. No.: 617,131

[22] Filed: Jun. 4, 1984

Related U.S. Application Data

[60] Division of Ser. No. 512,699, Jul. 11, 1983, abandoned, which is a continuation of Ser. No. 240,115, Mar. 3, 1981, abandoned.

[30] Foreign Application Priority Data

| | | | |
|---|---|---|---|
| Mar. 17, 1980 | [JP] | Japan | 55-34345 |
| Dec. 11, 1980 | [JP] | Japan | 55-175031 |
| Dec. 13, 1980 | [JP] | Japan | 55-176276 |

[51] Int. Cl.[4] ..... C22C 38/26; C22C 38/34

[52] U.S. Cl. ..... 420/100; 420/104; 420/127

[58] Field of Search ..... 72/302, 342, 364, 378; 428/602, 584; 219/7.5; 264/291; 29/DIG. 24, DIG. 41; 75/126 F; 420/100, 104, 127

[56] References Cited

U.S. PATENT DOCUMENTS

| | | | |
|---|---|---|---|
| 545,022 | 8/1895 | Jackson | 72/302 |
| 1,907,907 | 5/1933 | Varney | 219/68 |
| 2,502,005 | 3/1950 | Hansell | 219/7.5 |
| 3,707,754 | 1/1973 | Meleka et al. | 72/364 |
| 4,007,616 | 2/1977 | Aleck | 72/378 |

FOREIGN PATENT DOCUMENTS

| | | | |
|---|---|---|---|
| 2792 | 3/1964 | Japan | 72/302 |
| 1242014 | 8/1971 | United Kingdom . | |
| 1285872 | 8/1972 | United Kingdom | 72/342 |

OTHER PUBLICATIONS

"Spring Designers Handbook", Carlson, Harold, Marcel Dekker, Inc., 1978, pp. 27–57.

"Spring Design–a Practical Treatment", W. R. Berry, Emmott & Company Limited, 1961, p. 41.

"Handbook of Mechanical Spring Design", Associated Spring Corporation, 1952, pp. 6–9.

"Mechanical Springs", Wahl, A. M., 2nd ed., McGraw–Hill Book Co., Inc., N.Y., 1963, pp. 19–29.

"Spring Manufacturing Handbook", Carlson, Harold, Marcel Dekker Inc., N.Y., 1982, pp. 52–53.

*Primary Examiner*—John J. Zimmerman

*Attorney, Agent, or Firm*—Browdy and Neimark

[57] ABSTRACT

Method for manufacturing a tapered rod for a coil spring from a metallic material of mainly steel in a linear state, by imparting heating to the same with a predetermined temperature gradient pattern in the axial direction thereof while or before pulling by tensile force the metallic material chucked at two axially distant points in either direction in a gradually decreasing or stepwise decreasing speed, until a desired tapered portion is formed. An apparatus preferably employed for this method comprises a pulling mechanism for chucking and pulling the material, an electric current supplying mechanism for supplying predetermined amount of current to the material between the two chucked points, a plurality of cooling units arranged axially along the material for positionwise cooling the material so as to make the temperature gradient thereon, a temperature detecting device for detecting the surface temperature of the material for feeding back the detected data to the current supplying mechanism, and a heating temperature controlling device for controlling the amount of the current flowed there.

3 Claims, 12 Drawing Sheets

FIG. 16(a)
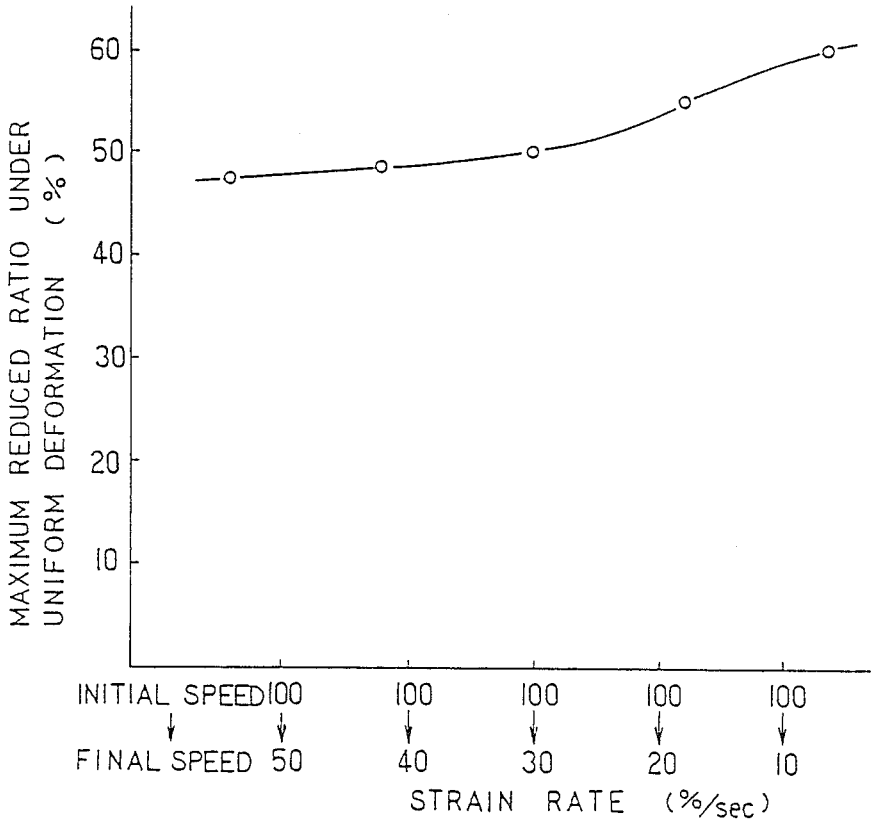
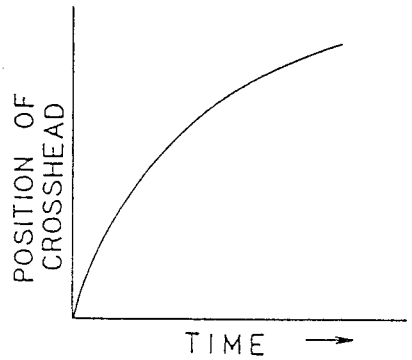
FIG. 16(b)

METHOD FOR MANUFACTURING TAPERED RODS

This application is a division of application Ser. No. 512,699, filed July 11, 1983, now abandoned, which is a continuation of Ser. No. 240,115, filed Mar. 3, 1981, now abandoned.

BACKGROUND OF THE INVENTION

This invention relates to a method for manufacturing tapered rods. More particularly, it relates to the method for manufacturing tapered rods and bars from a predetermined metallic material extremely efficiently, i.e., minimizing the material loss and maximizing the productivity, and also to an apparatus applicable for the method.

In recent times coil springs used for cars and railroad wagons have been gradually changed, for improving the comfortableness of riding to the passengers, from the conventional constant diametered ones to tapered coil springs made of tapered rods featured in the so-called nonlinear characteristics. The tapered rods employed for the rapidly prevailing tapered coil springs are provided with a larger diametered portion (a) in the central portion and a continuously diameter diminishing tapered portions (b) on either side of the former, as shown in FIG. 1. In one example, the ratio between the larger diametered portion (a) and the progressively diameter diminishing portion (b) is b:a:b=1:1:1, and the whole length L, i.e., (a)+2(b) designates the length of a material for one coil. In this way a rod having the larger diametered portion (a) in the central portion and the diameter diminishing portions (b) on either side is actually employed as a material in production plants of the tapered coil springs. In a coil spring made of a tapered rod of this type the varying trend of its height which is observed according to the variation of load is non-linear (A) as can be seen in FIG. 2, while in a conventional coil spring made of a constant diametered rod the trend of the height thereof as the load varies is regularly linear (B). This difference (A) and (B), i.e., the height in proportion to the load variation constitutes the difference in the comfortableness. In other words, the tapered coil springs showing the non-linear trend line of the height greatly contributes to the betterment of the riding comfort of various wagons.

The tapered rods as material of the tapered coil springs have been conventionally manufactured chiefly by machining wires or rods of a desired metallic material. Machining of the metallic material naturally yields a great deal of material loss, and needs in addition much of the time, remarkably degrading the productivity.

In some quarters hot forgoing method which is called rotary swaging method employing a swaging machine is adopted to manufacture this type of tapered rods. This method is meritorious indeed in diminishing the material loss, leaving however inevitable long machining hours still unchanged.

All of the conventional manufacturing methods of the tapered rods were extremely low in productivity. And no appreciably improved apparatuses or systems were developed for the solution of the above-mentioned problems.

SUMMARY OF THE INVENTION

It is a primary object of this invention which was made from the above-mentioned background to provide a method or process for manufacturing a tapered rod or bar.

It is another object of this invention to provide a practical method, being high in productivity and low in material loss yielding, for manufacturing a tapered rod having an axially varying diameter from a predetermined metallic material.

It is still another object of this invention to provide a practical method for manufacturing continuously and in a short time a tapered rod which is suitably utilized as a tapered coil spring.

It is further object of this invention to provide a method for manufacturing a tapered rod wherein the taper configuration is featured in enlarging the ratio of the sectional area (Amax) of the maximum diametered portion to that (Amin) of the minimum diametered portion, i.e., (Amax/Amin) without inviting a problem of material breakage in the process, etc.

Other objects of this invention will become apparent to those skilled in the art from the study of the following detailed description of the preferred embodiments and examples in conjunction with the accompanying drawings.

What were essentially attempted in this invention for attaining above objects can be summarized to that the pre-selected metallic material is imparted locally temperature gradient in the axial direction by heating and that the heated metallic material with the locally gradient temperature pattern is axially stretched by pulling. The metallic material placed under tensile force for pulling will be a tapered rod having a locally varied diameter in the axial direction according to the gradient pattern of the heating temperature. By means of this unique method an attempted tapered rod can be obtained in a remarkably shortened time of process, yielding much lesser material loss. This method has thus succeeded in enhancing the operation efficiency to the highest possible extent.

A metallic material or blank can be made into a desired tapered rod, in this invention, only by being imparted a desired pattern of temperature-gradient heating to the taper needed portions thereof alone before being given the axial tensile force. By this method a desired tapered rod can be obtained in a remarkably short time, eliminating all of the conventional tedious and time-consuming processes such as machining process which needs much time and material loss, hot forging process which requires a long and inefficient forging time, etc. This method can be said to have much contributed to the cost reduction of the tapered rods through the simplification of the process and the shortening of the required time. If the above described method is applied to such a long metallic material as a coiled wire by forwardly moving it, step by step, by a predetermined length, a long series of continued tapered rods having a desired tapered portion for each desired distance can be produced. By cutting this long material already processed per each desired section, many tapered rods of predetermined length can be obtained efficiently and advantageously.

The inventors of this method have discovered from further studying that strain rate, i.e., rate of deformation of the sectional area of the metallic material per unit of time when it is stretched or pulled to be deformed in the axial direction is of extreme importance. It is furthermore important that the deformation of the sectional area in the minimum diametered portion is kept within a predetermined extent. They have found that effective manufacturing of the desired tapered rods can be achieved by observing this principle in the actual practice.

This invention which has been completed from the above discovery of knowledge is characterized in the following mode of process. The strain rate or speed, when the metallic material is given axial tensile force while being under an axial temperature gradient heating for being made into a tapered rod, is maintained in the range of 0.5%/sec-1000%/sec. It was ascertained that a metallic material can be efficiently processed into a desired tapered rod by this method without inviting any breakage of material due to the so-called local necking or contraction.

Through still further studying the inventors have found the following fact. That is, pattern or mode of pulling the metallic material, more particularly timewise pattern of pulling is of more importance, when the material is stretched so that the rate of strain in the minimum diametered portion is kept within a predetermined range. By observing the discovered timewise pattern of pulling pattern, a good tapered rod of large rate of reduction, i.e., the sectional area of the maximum diametered portion divided by that of the minimum diametered portion (Amax/Amin), can be obtained. Formation of a cylindrical, not tapered but parallel, portion with a constant diameter in the minimum diametered portion is also effectively obtained by observing this pattern.

The idea of the above-mentioned timewise pattern of pulling has given the following features to the method of this invention. When a metallic material is pulled by tensile force, under the influence of axially temperature gradient heating, at a rate of strain or deformation within the range of 0.5%/sec-1000%/sec in the minimum diametered portion for forming a tapered rod with an axially varied diameter, the speed of pulling must be varied such as gradually from high speed to low, reducing intermittently or stepwise the pulling speed by dividing the whole pulling amount into several sections. This pattern of pulling enabled to form effectively a desired tapered portion without incurring breakage of material by local necking and to simultaneously form a cylindrical and parallel portion with a constant diameter in the minimum diametered portion.

By this invented method, i.e., by applying the suitably timewise controlled pattern of pulling a desired tapered rod with a fairly strictly controlled diameter in precision can be got. This method enabled formation of a precisely controlled tapered rod in one pulling process without requiring any finish machining, contributing a great deal to shortening of the process time and consequent production cost reduction.

BRIEF DESCRIPTION OF THE DRAWINGS

FIG. 16 (*a*) and (*b*) are respectively a graph for showing the result observed in Example 6 of progressively speed reducing tensile force pulling and a graph for showing the curve of progressively reduced speed;

DETAILED DESCRIPTION OF THE PREFERRED EMBODIMENTS

Figure 1:
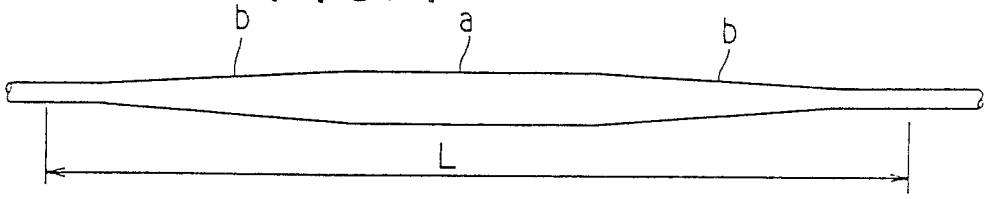
FIG. 1 is a schematic view for showing an example of a tapered rod used as a coil spring.

Metallic materials used for forming the tapered rods in accordance with this invention are usually in the form of wires and rods. Mostly they are of steel, but other non-ferrous metals are by no means excluded. As preferably usable material for the tapered coil springs the metallic material is desired to be steel wire rod containing carbon of 0.35–1.10% by weight, and further containing, if desired, silicon not exceeding 2.5%, manganese not exceeding 1.5%, copper not exceeding 3.0%, nickel not exceeding 3.0%, chromium not exceeding 5.0%, molybdenum not exceeding 1.0%, vanadium not exceeding 1.0%, boron not exceeding 0.05%, aluminum not exceeding 0.1%, and titanium, niobium, zirconium, tantalum, tungsten, hafnium respectively not exceeding 0.5, and the balance in iron.

Carbon content of the above-mentioned steel wire rod as the preferable material for the tapered rods should be regulated within the range of 0.35–1.10%. In case of the carbon content less than 0.35% quench hardness is difficult to be obtained in the heat treatment process after the coil formation, which deteriorates necessary characteristics as a spring. On the contrary, in case of the carbon content more than 1.10% proeutectoid cementite will become enormous, which deteriorates life of the spring due to fatigue. Among the occasionally added elements, silicon is effective for improving load loss resistance, manganese is good for improving hardenability, copper is effective for enhancing weather proof and preventing decarburization during the heat treatment, nickel is effective for improving the hardenability and strength (toughness), chromium and molybdenum improve hardenability and resistance to temper softening, vanadium is good for improving strength by fining crystal particles, boron is capable of improving hardenability by adding trace amount thereof, aluminum is effective in elongating the life against fatigue as well as in fining crystal particles so as to lower the ductile-to-brittle transition temperature, and titanium, niobium, zirconium, tantalum, tungsten, hafnium are respectively advantageous in forming fine carbides so as to improve the resistance to temper softening. All of those additives may be contained separately or in combination within the predetermined ratio of content. Other inevitably contained elements as trace amount of impurities in the course of industrial manufacturing process of the steel wires as the material such as phosphorus, sulphur, arsenic, tin, antimony, zinc, selenium, etc. are all harmless.

Figure 3:
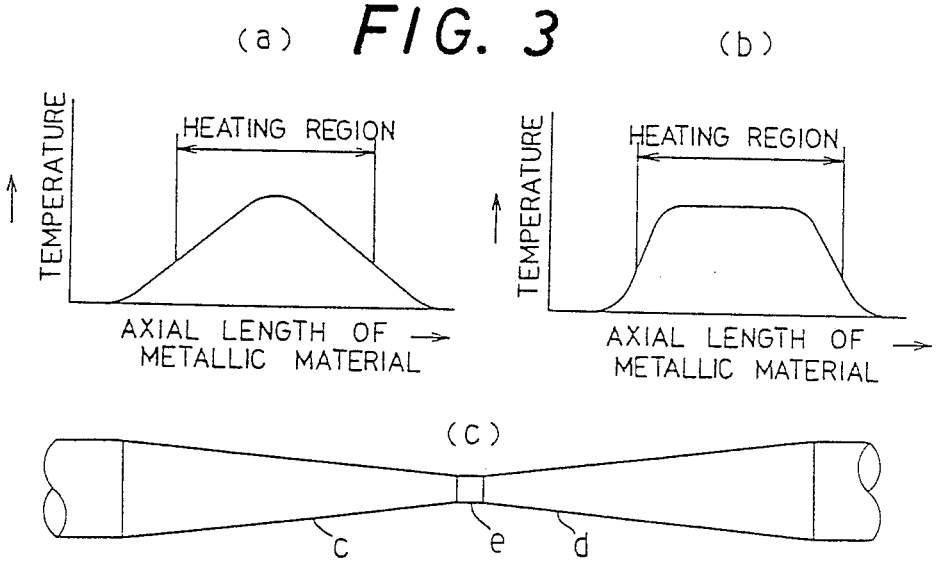
FIG. 3 (*a*) and (*b*) are respectively a graph for showing a different temperature distribution in the axial direction on a metallic material, and (*c*) is a schematic view for showing the status of a metallic material after pulling.

As to the temperature gradient imparted to the steel wire as the metallic material, the pattern thereof should be varied in many ways according to the materialistic quality and dimension of the steel wire, the heating temperature, the tensile condition, the shape of the taper desired, etc. It may be determined specifically for each case, not be decided uniformly or indiscriminately. What can be said in general is that a portion of the steel wire under a high temperature will become finer of thinner in the later tensile operation and a portion under a low temperature less thin. Consequently, for the formation of a continuous taper where the diameter increases or decreases continuously as shown in FIG. 1 a temperature gradient pattern in (*a*) or (*b*) of FIG. 3, for example, is preferably utilized. In particular, when a pattern of mountain form temperature gradient, as in FIG. 3 (*a*) and (*b*), is adopted where the central portion in the axial direction of the metallic material is high in temperature and the further portions away from the central portion are lower, tapered portions c, d, faced to each other as shown in FIG. 3 (*c*) are produced. So a continuously pulled steel wire with many mutually faced tapered portions c, d, at a predetermined inter-distance in the axial direction of the wire may be cut at each of the minimum diametered portions e inbetween the tapered portions c, d for providing may tapered rods with a predetermined length shown in FIG. 1 effectively and continuously.

As for the imparting of the temperature gradient heating, the maximum heating temperature is preferred to be maintained within the range of 600° C.–1000° C. At a temperature below 600° C. breaking elongation of the material becomes low, for example, in case of the earlier mentioned steel wire the elongation against breakage being less than 40%. The material may be broken before it is finally made into an aimed tapered rod due to a possible local necking. At a temperature over 1000° C., on the contrary, oxidization and decarburization of the material surface rapidly progresses so as to greatly deteriorate the life of the final product as a spring against fatigue, which is an unpreferable phenomenon.

As to a way of imparting the temperature gradient heating, all of the known methods such as direct heating, high frequency induction heating, gas burning heating, infrared ray heating, indirect heating by an electric furnace, etc. are permissible. Any one of those methods may be chosen in accordance with the circumstances. In specifically imparting the temperature gradient heating to the metallic material by selecting a suitable one from the above-mentioned methods, the following two are, for example, recommended as preferable, (1) heating the metallic material directly so that the predetermined temperature-gradient pattern may be formed thereon in the axial direction, and (2) after having heated or while heating the metallic material up to a predetermined high temperature cooling down the same, by adjusting the temperature, so as to form the predetermined gradient pattern thereon in the axial direction. More concretely speaking, heating amount or cooling amount per each portion of the metallic material in the axial direction can be varied according to the pattern of the desired taper, such as by dividing the whole length of a taper, from the central portion to the end portion on either side thereof, into several sections for giving to each section respectively varied amount of cooling air required according to the pattern of the taper, by positionwise varying the diameter or the pitch of electric coils used in a high frequency induction heater in the axial direction of the metallic material according to the pattern of the taper, or by positionwise varying the flow amount of the fuel gas for varying the extent of heating according to position in the axial direction of the metallic material according to the pattern of the taper, and in case of electric resistance heater input amount of the power to a plural series of resistance heating elements can be preferably adjusted per each position of the metallic material according to the pattern of the taper.

A metallic material which is given this predetermined temperature gradient pattern is applied tensile force in the axial direction while being under the gradient heat for becoming desired tapered rod by gradually changing its diameter according to the pattern of the temperature gradient. In general a portion under a high temperature becomes small in the diameter and a portion under a low temperature the diameter thereof becomes less small.

This tensile force is applied on a metallic material under the influence of the temperature-gradient heating according to the quality, shape, and the targeted form of the taper so as to get a desired rate or speed of strain on the material. According to studying of the inventors, this rate of strain of the material must be controlled by all means, for efficiently producing tapered rods of desired shape, while the material is pulled under the temperature-gradient heating. It was also discovered by the inventors that controlling of the rate of strain is preferably made at the minimum diametered portion (maximum uniformly contracted portion) of the formed tapered rod within the range of a certain predetermined value.

In other words, the tapered rods attempted to get in the method of this invention should be applied tensile force at the minimum diametered portion, i.e., the portion under the highest temperature of heating, within the range of process-strain rate ($\epsilon$) 0.5%/sec–1000%/sec. Under this condition of tensile deformation desired tapered rods are obtained efficiently, easily, and without giving rise to a problem of material breakage, etc. In this instance the rate of strain or deformation 0.5%/sec should be regarded the lowest limit, because the temperature-gradient pattern in the axial direction actually functions as if it were flat or non-gradient at a rate less than this limit value 0.5%/sec. On the contrary, when the rate of strain exceeds 1000%/sec fairly high heat is generated at the time of plastic deformation of the material, giving rise to local heating and local necking which possibly cause breakage of the material. It must be observed therefore as the upper limit. The rate or speed of strain ($\dot{\epsilon}$) here is meant the amount of deformation per unit of time at the minimum diametered portion, more specifically, the amount of variation of the sectional area, which can be determined in general by the following formula, $$\dot{\epsilon} = \frac{(A_o - A) \times 100}{A \times t} \ (\%)$$

wherein $A_o$: original sectional area of the metallic material ($cm^2$)

A: sectional area of the tapered rod (metallic material after the tensile deformation) at the minimum diametered portion ($cm^2$)

t: duration of tensile deformation

In this invention, how to pull the metallic material within the predetermined range of the strain rate, or the process-strain speed ($\dot{\epsilon}$), is a problem, more specifically, (a) gradual changing of the pulling speed, from high to low, of the metallic material at the crosshead when than same is held for pulling, and (b) dividing the pulling amount into several steps for degrading the tensile force stepwise and pulling the material intermittently are two of the preferably employed ways of pulling. Either of those two ways enables easy formation of a tapered rod with a large rate of reduction, which is the rate between the sectional areas at the maximum diametered portion and the minimum diametered portion, and with a sufficient length of the cylindrical or parallel portion having a constant diameter at the minimum diametered portion simultaneously formed with the tapered portion.

A metallic material under a predetermined temperaure-gradient heating, when it is pulled at a constant crossheat speed, possibly produces a contracted (constricted) portion at a relatively early stage of pulling, forming a tapered portion only without parallel portion some time, or forming parallel portion only some other time with a tapered portion, even if it is made, having a relatively small rate of reduction. Anyway a good tapered rod with a large rate of reduction can not be got by this pulling way of a constant speed.

This invention has succeeded in obtaining an excellent tapered rod with a large rate of reduction, perfectly eliminating the conventional disadvantage, by adopting the above-mentioned specific pattern or mode of pulling. Theoretical reasoning for this simultaneous achieving of the tapered portion with a large rate of reduction and the parallel portion can be made as follows:

Consider first a case wherein the pulling amount is divided into several steps for applying the same stepwise and intermittently while degrading the speed. Deformation of the metallic material under a high temperature is well balanced between strain hardening caused by deformation and softening by restoration. If the pulling is suspended immediately before the first necking begins to take place, that is the limit for the uniform deformation of the material, leaving the material as it is for several seconds, the material protected from deformation is annealed in the meantime by the still existing high temperature. The ductility of the material is greatly enhanced by the decrease or extinction of the transition caused by the deformation so far. By means of repeating this process the material will reach far greater rate of reduction in comparison to a case where a constant tensile force is applied in one step. During the initial stage of pulling in a relatively high speed the material is liable to receive the influence of the temperature gradient in general to mainly form the taper portion, while during the later stage of decelerated speed the central part of the material under the high temperature region chiefly receives the deformation, resulting in forming the parallel portion of the constant mininum diameter. It is necessary to make the pulling speed slower when the process stage goes to the later part, because the deformable portion is gradually limited by the temperature lowering of the material. This inevitable lowering of the crosshead speed will naturally decelerate the above-mentioned strain rate ($\dot{\epsilon}$).

On the other hand, even in case of gradual deceleration of the crosshead speed from high to low, in order to decrease the rate of strain little by little, the strain hardening by deformation is overcome by the softening caused by the restoration to give the material self-annealing effect due to the remaining temperature. So in this case the rate of reduction enjoyed is much larger than that is observed under the pulling condition of the constant speed. In the invented way of pulling when the speed is lowered stepwise or gradually, the last and most slowed pulling speed is of importance for making the parallel or cylindrical portion of constant diameter.

In case tapered rods, whose preferred form is shown in FIG. 3 (*c*), having a pair of opposite tapered portions c, d are made from a continuous long wire or a rod by a continuous and repetitive forming operation, such a long wire or rod having a plurality of tapered portions with a predetermined equal distance therebetween can be, before or after a necessary after-treatment and/or after-process, cut at a predetermined position one after another to have finished tapered rods of constant length.

It is needless to say that this method is also effective to form one or two tapered rods from a relatively short material of limited length instead of the earlier mentioned long material. The taper portion formed on the material may be various in its shape, such as linearly and continuously diameter increasing or decreasing like one shown in FIG. 3 (*c*), with one or two steps in c (d) portion, or outwardly convex or inwardly concave. As to the mode of having the taper portion, various modifications are permissible, for example, forming only one taper portion, forming a large diametered portion in the middle with two small diametered portions on either side thereof just contrary to the mode in FIG. 3 (*c*), in addition to the mode having two large diametered portions on either end as can be seen in FIG. 3 (*c*).

For actually reducing the above-mentioned method of this invention the undermentioned apparatus is preferably employed.

Figure 4:
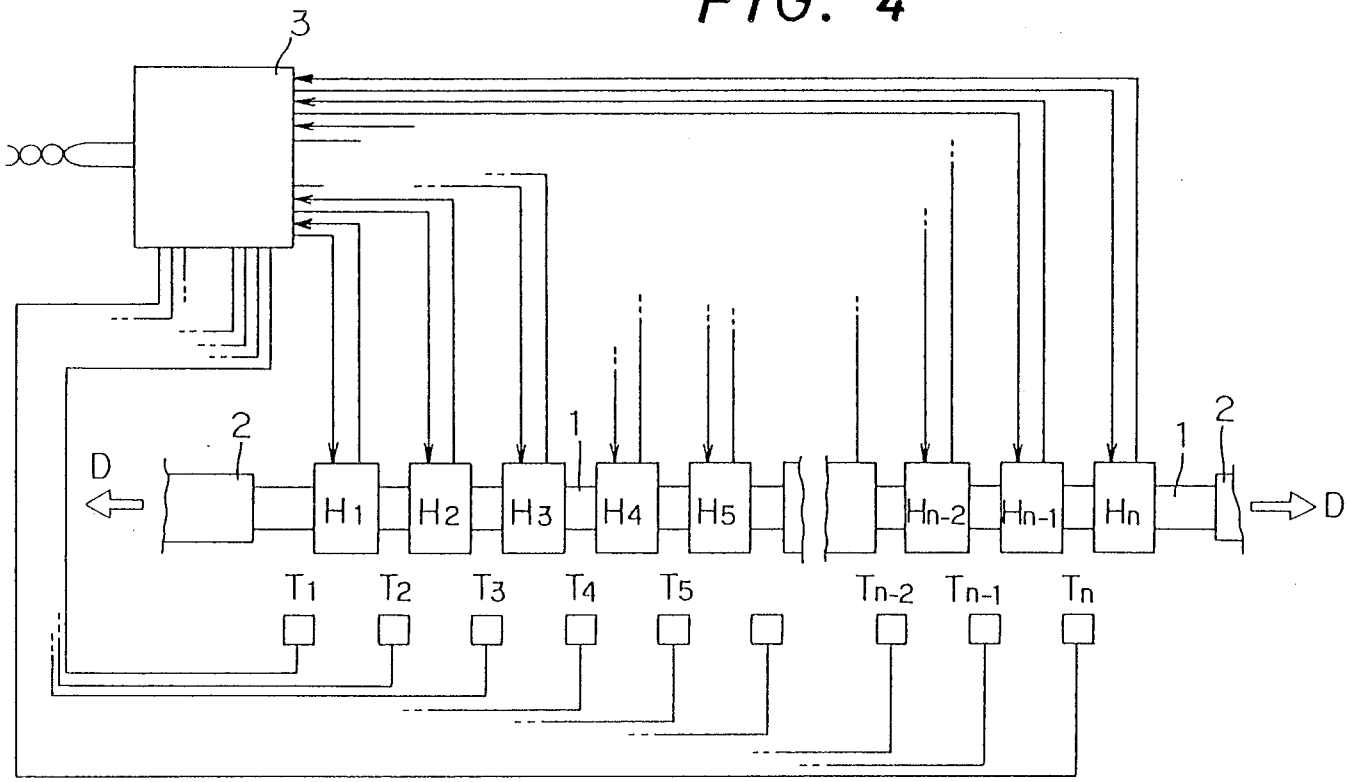
FIG. 4 is a diagramatic view for showing an example of apparatus preferably employable for reducing the method of this invention.

An apparatus including a pulling mechanism for pulling a metallic material of wire state chucked at two points on the axial direction of the material in a direction enlarging the distance between the two points, and heating means composed of plural steps arranged between the two points for heating the metallic material at each step so as to form a predetermined temperature gradient pattern to the material, whereby the metallic material is imparted the temperature-gradient heating while being pulled in either direction by the pulling mechanism to become a tapered rod with a varying diameter in the axial direction thereof. An example of the apparatus is shown as a diagrammatic view in FIG. 4, wherein numeral 1 designates a round steel rod. The rod 1, which is chucked at a chuck 2, 2 on either end thereof is pulled by a suitable means such as a hydraulic cylinder (not shown) so that the distance between the two chucks 2, 2 may be enlarged. That is to say, the rod 1, is pulled in two directions marked with D arrows so as to be elongated between the chucks 2, 2. Along the axial direction of the rod 1 high frequency induction heaters, n pieces from $H_1$ to $H_n$, whose number of coil winding is identical for each, are arranged in the axial direction of the rod 1 such that each of the heaters constitutes a heating zone for each position of the rod 1 in the axial direction thereof. To each of the coils $H_1$–$H_n$ independently controlled or regulated high-frequency current to a predetermined extent is flowed from a controlling means 3. By means of varying the amount of current flowed to each coil $H_1$–$H_n$, density of the induction current flowed in each position of the rod 1 is varied, which means the heating amount of the rod 1 is varied according to the position thereof. It can be said further in other words that a temperature-gradient pattern is formed corresponding to each position of the rod 1. The invented apparatus is further provided with a series of heat-measuring meters or temperature detectors $T_1$–$T_n$, each being faced to each of the heating zones on the rod 1, for measuring or detecting the actual temperature of the heated zone respectively. In order to adjust the heating temperature at each heating zone, the temperature picked up at the meters $T_1$–$T_n$ is respectively fed back to the controlling means 3 for thereby controlling the current amount flowed to each of the coils $H_1$–$H_n$ independently.

In a apparatus of such a structure the rod 1, which is given a temperature-gradient heating to each heating zone thereof while being pulled in either D direction at the chuck 2, 2, is affected by respectively different amount of high-frequency heating according to position in the axial direction. The rod 1 will show different rate of extension or elongation, although it is under one uniform tensile force, according to the position in the axial direction of the rod 1. This is why a desired taper is formed.

In an apparatus of such a structure the current flowed to the stepped coils $H_1$–$H_n$ is respectively controlled or regulated, and the actual temperature at each heating zone formed by the coils $H_1$14 $H_n$ is measured by the meters $T_1$–$T_n$ and fed back for thereby controlling the temperature of the coils $H_1$–$H_n$ to a target value. Consequently the temperature of each coil $H_1$–$H_n$ can be regulated at will for desirably varying the form of the taper. The heating temperature and consequently the form of the taper can be exactly controlled in such an apparatus.

Figure 2:
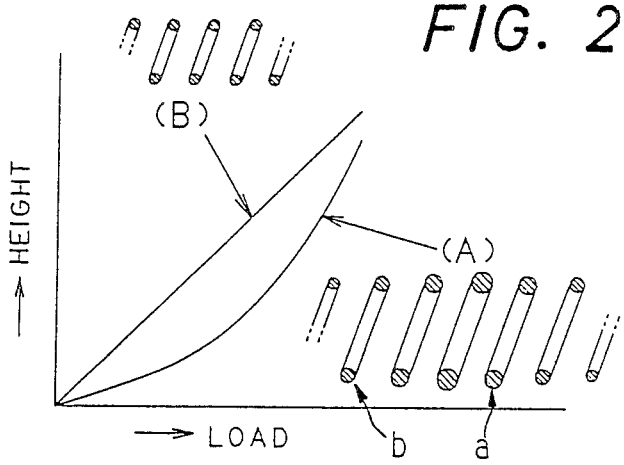
FIG. 2 is a graph for comparatively showing the feature of an ordinary coil spring and a tapered coil spring.

Although in the above exemplified apparatus a plurality of coils with an identical number of coil winding are parallelly connected for being independently controlled in respect of the current amount, some alterations are permissible such as varying the number of coil winding of each coil, connecting each coil in series while varying the number of coil winding or varying the diameter of each coil, etc., in order to flow predetermined current amount to each coil so that each heating zone of the metallic material may be affected by a different current density respectively. More specifically, for obtaining a heating pattern shown in FIG. 2 the density of the coil turn number should be made larger in the induction heating coils located in the central portion of the metallic material in the axial direction and that of the coils located the farther away from the central portion the smaller, and similarly the diameter of the coil should be, if a way of varying the coil diameter is adopted, made smaller in the induction heating coil located in the central portion of the metallic material in the axial direction and that of the coils located the farther away from the central portion the larger.

In the exemplified apparatus another heating means such as a plurality of burners arranged stepwise can be practicable in place of the above-mentioned induction heating mechanism.

As a manufacturing method for the tapered rods in this invention direct resistance heating method is also preferably applicable. While directly flowing electric current to a wire state metallic material from the two points thereon in the axial direction, dispose a plurality of cooling zones in the axial direction of the material for imparting positionwise controlled cooling to each of the positions on the material. The heated material by the current flowing while being under pulling in either direction is patternwise cooled by the temperature gradient cooling zone. The material thus can be formed into a tapered rod with varying diameter in the axial direction.

For realizing the above-mentioned tapered rod manufacturing the heating amount by the direct resistance heating is measured at any suitable position between the two points on the material for controlling the heating amount by the data of the measurement. This apparatus is characterized in that the temperature of heating at the measuring position itself is so controlled as to be at the targeted level. By this method various advantages have been achieved such as, enhancement of the rate of yielding, shortening of the processing time, obtaining of tapered rods substantially as targeted, and easy manufacturing of attempted articles.

Figure 5:
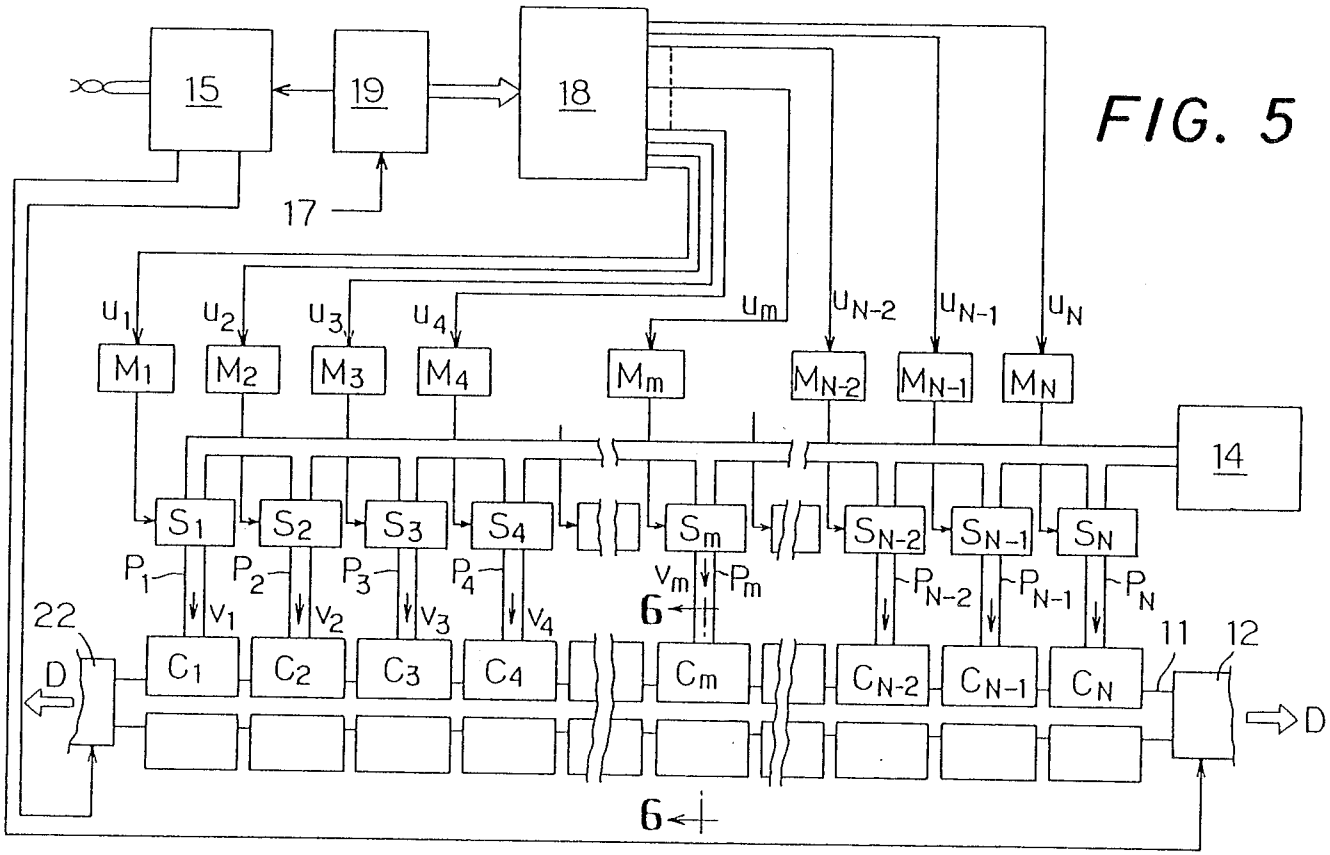
FIG. 5 is a diagramatic view for showing another example of apparatus preferably employable for reducing the method of this invention.
Figure 6:
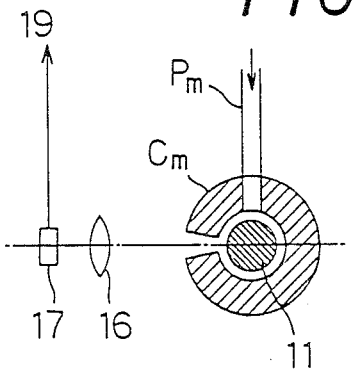
FIG. 6 is a sectional view of FIG. 5 taken along the section line 6—6.

With reference to FIGS. 5 and 6 an apparatus of this type will be described. Numeral 11 designates a round steel rod, either end thereof is chucked respectively by a chuck 12, 22 for being pulled by a not-shown suitable pulling means such as a hydraulic cylinder in an inter-chuck distance enlarging direction, i.e., in the direction marked with D arrows enlarging the length of the rod. The chucks 12, 22 simultaneously function in this connection as a contact for flowing the current of direct resistance heating. The current led through a current adjuster 15 is flowed, having been regulated to a predetermined amount, to the rod 11 by way of the chucks 12, 22 to directly heating the same. Along the longitudinal direction of the rod 11, n pieces of coolers-by-air with a sectional configuration of C type; $C_1$–$C_n$ are arranged to constitute cooling zones at each position of the rod 11 to be cooled. To each of the coolers-by-air $C_1$–$C_n$ cooled gas such as air is supplied from a gas supplying means 14, for example, a compressor, through each passage $P_1$-$P_n$ under controlling of flow amount controllers $S_1$-$S_n$ so as to cool each position of the rod 11 faced respectively to the coolers-by-air $C_1$–$C_n$.

A known temperature detector consisting of a lense 16 capable of detecting the surface temperature of the rod 11 covering the whole length thereof and an image sensor 17 is disposed for measuring the surface temperature of the rod 11 at least at a portion opposite to a color $C_m$ located in the central portion of the rod 11 between the two chucks 12, 22. The temperature detector collects radiated energy from the surface of the rod 11 to generate a signal corresponding to the temperature. The signal from the temperature detector (16, 17), which is corresponding to the surface temperature of the rod 11, is applied to a temperature converter 19 for being, after having been converted there to an electric signal, led to a current adjuster 15 and a cooling control system 18. At the current adjuster 15 the current to be flowed to the rod 11 is so regulated based on the received temperature signal as to be adapted to the set value therein, i.e., the targeted heating temperature at the measurement position. At the cooling control system 18 a commanding signal is generated, caused by an electric signal from the temperature convertor 19, to motors $M_1$–$M_n$ according to the set controlling pattern therein. Flow amount adjustors $S_1$–$S_n$ are respectively actuated by each motor $M_1$–$M_n$ to adjust the air amount $V_1$–$V_n$ led to each of the coolers-by-air $C_1$–$C_n$. The rod 11 is cooled in this mode to a predetermined temperature at a desired axial position, that is to say, the rod 11 receives a predetermined pattern of heating under a predetermined pattern of temperature-gradient.

Assuming an example wherein coolers-by-air $C_1$–$C_n$ are disposed in odd number n description of the apparatus will be made. The temperature of the central portion m of the rod 11 is adjusted by the regulation of the current amount flowed there. This adjustment of heating is carried out by regulating with PID action the current amount flowed to the rod 11, through the current adjuster 15 aiming the target value $\overline{Tm}$ based on the input value from the temperature converter 19 which is under the influence of the detected data of the surface temperature of the rod 11 at the middle portion by means of the temperature detector (16, 17). Through this heat adjustment at the middle portion of the rod 11, the whole heating condition of the rod 11 can be detected or known. As the direct resistance heating of a rod characteristically forms a peak of the heating at the middle portion thereof in general, in a case wherein a mountain-like pattern of heating with a peak in the middle is formed on the rod 11, as shown in FIG. 3 (*a*), heat adjustment or regulation conducted at the middle portion of the rod 11 is preferably adopted. It is of course possible to detect the surface temperature at a place of the rod 11 other than the middle portion for presuming therefrom the whole heating condition of the rod 11 and conduct the heat adjustment suited for the detected condition. If and when the temperature pattern given to the rod 11 is altered the detection places of the surface temperature are naturally altered, and it is also possible to detect the surface temperature at plural places of the rod 11 for performing the heating regulation based on the predetermined targeted value.

In the heating regulation based on the highest temperature portion in the middle (m) of the rod 11, the cooling control, i.e., current flow heating plus air cooling, is normally not practiced. Only when the temperature $T_m$ at the position m has largely overshoot cooled air is blown through the passage $P_m$ into the cooler-by-air $C_m$. In some cases, however, it is rather preferable, according to the pattern of the temperature-gradient, to carry out the heating regulation at the position m by parallelly using the current flow heating and the air cooling, which naturally permits the heating regulation at other places of the rod 11.

Temperature at other places than the position m is usually started to be adjusted by cooling when the temperature at the position m has reached the targeted temperature $\overline{Tm}$, because the position m is the place to be heated highest. It is of course permissible to begin adjusting the temperature of the other places by regulating the heating temperature by air cooling at the beginning of heating, if the circumstances require. The cooling adjustment is executed by controlling the flow amount $V_1 \ldots V_n$ of cooling gas (air) delivered to the coolers-by-air $C_1 \ldots C_n$ which is conducted by the motors $M_1, M_2, \ldots M_n$ through suitable adjustment of the degree of opening of the valve or slit in the flow amount adjusters $S_1 \ldots S_n$. And the flow amount or supply amount of the cooling gas can be determined beforehand according to each temperature gradient pattern by experiments or the like.

The temperature of the rod 11 can be thus regulated in two ways, one being the heating regulation to the current flowing thereto by regulating the current amount through adapting the actually measured surface temperature of the rod 11 to the target temperature, and the other being the cooling control executed by the plurality of coolers-by-air $C_1, \ldots C_n$ axially arranged which are variable in the cooling capacity from each other due to the predetermined amount of cooling gas flown to each of them. Such parallel regulation of heating and cooling enables effective formation of a temperature-gradient pattern shown in FIG. 3 (*a*), for example.

A material, or a rod 11, placed under such a temperature gradient is, when bidirectional predetermined tensile force is applied between the two chucks 12, 22, formed into a tapered rod with taper portions c, d shown in FIG. 3 (*c*) because of positionwise different rate of elongation of the material.

The temperature of the rod 11 at the temperature measuring position m, which is the reference for the heating regulation, can be exactly controlled to the target value $\overline{Tm}$, but as to the temperature at other places some discrepancy or difference may take place between the actual heating temperature and the target temperature, because it is controlled in two ways, i.e., cooling from the coolers-by-air $C_1, \ldots, C_n$ whose amount of cooling gas is determined by experiments or the like, and direct resistance heating. For the purpose of eliminating this discrepancy, the flow amount of the cooling gas introduced to the coolers-by-air $C_1, \ldots, C_n$ is also controlled by the temperature data measured by the temperature detector (16, 17). It is of course ideal to give the rod 11 the cooling control and the heating regulation simultaneously, but there is a practical problem there, that is, the current flow heating needs only a few seconds, while the cooling rate in the gas cooling is somewhat low. The temperature data obtained in one taper formation process including heating and pulling is effectively utilized for controlling the cooling amount in the immediately succeeding taper formation process in this invention as a recommendable method. In this way repetition of the same method enables substantially reaching the targeted temperature-gradient pattern finally. In a concrete example shown in FIGS. 5 and 6 the temperature detector (16, 17) carries out for this reason the temperature detecting at plural positions in the axial direction of the rod 11, and a commanding signal from the cooling control system 18 is generated after each termination of one taper formation cycle for being received by the coolers-by-air $C_1, \ldots, C_n$ as data for controlling the flow amount of the cooling gas in the next taper formation cycle. In other words, determination of the cooling gas flow amount is executed per each heating and temperature raising of the rod 11 for one taper formation cycle, but the determined value is by no means changed during one heating and temperature raising cycle, which means the control of the cooling gas flow amount is executed only intermittently.

Figure 7:
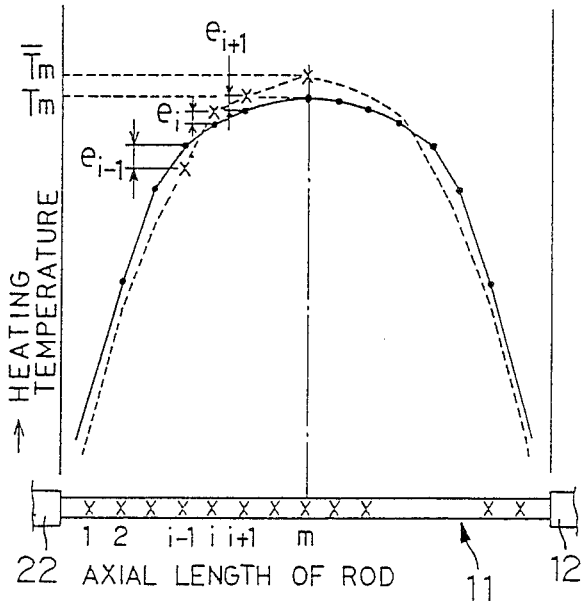
FIG. 7 is a graph for showing relation between the targeted temperature gradient pattern and the actually measured temperature pattern.

Determination of cooling gas flow amount to each of the coolers-by-air $C_1, \ldots, C_n$ is performed, more specifically, in the undermentioned mode. Taking up a case of cooling i position of the rod 11, for example, assume the temperature of the rod 11 at the position i as $T_i^{n-1}$, and those at i−1, i+1 respectively $T_{i-1}^{n-1}$, and $T_{i+1}^{n-1}$. And declination or deviation of the temperature of those positions, $T_i^{n-1}$, $T_{i-1}^{n-1}$, and $T_{i+1}^{n-1}$, from the target temperature of those positions, $\overline{T}_i$, $\overline{T}_{i-1}$, and $\overline{T}_{i+1}$, is assumed to be respectively $E_i^{n-1}$, $E_{i-1}^{n-1}$, and $E_{i+1}^{n-1}$, and this relation is shown in FIG. 7 as a graph, wherein the broken line indicates the target temperature distribution and the solid line does the temperature distribution in the previous controlling cycle.

In this situation, set value $U_i^n$ of the motor $M_i$ for determining the cooling gas flowing amount for the next controlling cycle of the cooler-by-air $C_i$ is determined by the calculation of the following equation in the cooling control system 18

$$U_i^n = U_i^{n-1} + ke_i^{n-1} + k'\left(\frac{e_{i-1}^{n-1} + e_{i+1}^{n-1}}{e_{i+1}^{n-1} + e_{i+1}^{n-1}}\right)$$

wherein $U_i^{n-1}$ designates a set value for the motor $M_i$ in the previous cooling cycle, and k and k′ are constants in the adjusting operation.

Therefore, if the surface temperature at each position of the rod 11 corresponding to each of the coolers-by-air $C_1, \ldots, C_n$ is measured the set value for the motor $M_i$ for determining the flow amount of the cooling gas can be calculated in the above-mentioned method, which enables a further exact cooling control well suited to the target temperature distribution in the next taper formation process or cycle. It is also possible, instead of respectively calculating from the data of actual measurement of the surface temperature at each position of the rod 11, to measure at plural positions thereon the actual temperature for deducting the temperature distribution in general and to determine the cooling amount or blowing air amount at each of the coolers-by-air $C_1, \ldots, C_n$, based on comparison between the measured temperature distribution and the target temperature distribution.

In this mode of cooling control, once attained target temperature distribution or gradient pattern will not be changed, but fixed for repeating the taper formation cycle on that fixed condition. The tapered rods having the targeted taper pattern can be obtained in succession in this way.

Figure 8:
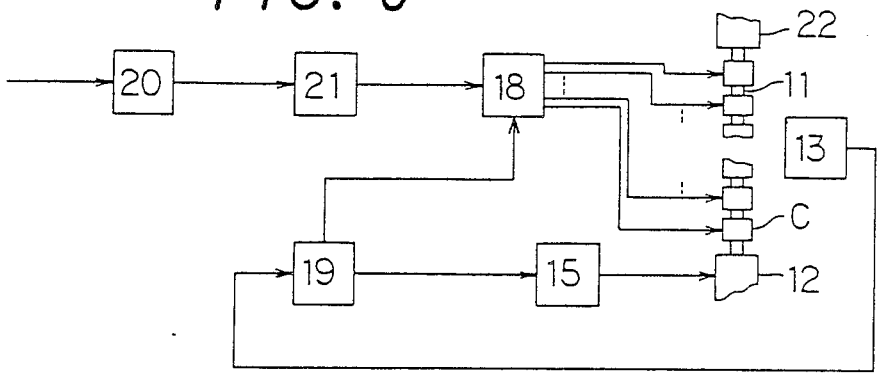
FIG. 8 is a diagramatic view for showing still another example of apparatus preferably employable for reducing the method of this invention.

A further excellent embodiment of an apparatus for this direct resistance heating method is shown in FIG. 8, wherein dimensional data of the actually produced taper pattern is entered to a calculator, in addition to the conventional control of the taper pattern based only on the surface temperature of the rod 11, for performing more exact cooling control adapted to the target taper pattern. Allotting the same numerals and signs to the same places as in the previous embodiment for omitting the description, only the dissimilar places are explained hereunder. Numeral 13 designates a temperature detector including a lense and an image sensor as in the previous embodiment, and to each of the coolers-by-air $C_1, \ldots, C_n$ arranged in the axial direction of the rod 11 predetermined amount of cooling gas which is controlled under a command from the cooling control system will be led in.

In the apparatus shown in FIG. 8, a tapered portion in an article processed in one taper formation cycle is measured dimensionally of its taper pattern by a dimension measuring device 20 for being entered to a temperature pattern adjuster 21, wherein adjustment or correction of the target temperature distribution pattern is carried out. More specifically, comparison between the target temperature pattern set in the temperature pattern adjuster 21 and the measured temperature pattern just entered is conducted for altering the temperature pattern which has been so far the reference for the cooling control. Relation between the dimensionally indicated taper and the temperature distribution pattern is made more close and intimate. Relation between the attempted taper pattern and the temperature pattern are not necessarily accordant in actual experiments, but discrepant sometime, wherein the temperature pattern adjuster 21 has its raison d'être. Adjusted temperature pattern information from the temperature pattern adjuster 21 is entered into the cooling adjustment system 18, wherein regulating command for directing the cooling gas flow amount to each of the coolers-by-air $C_1, \ldots, C_n$ for the next taper pattern formation process is generated based on the entered temperature pattern from the temperature converter 19 according to the corrected temperature pattern.

By entering the dimensional data taken from the actual taper pattern like this for the purpose of correcting the target taper pattern, reference for the cooling control of the next taper formation process is obtained, and the mutual relation between the actual taper pattern and the temperature pattern is improved all the more. Tapered rods closely resembled to the target taper pattern can be thus obtained, and repetition of the correction step of the temperature pattern, i.e., repetition of the taper formation cycle in this mode enables production of tapered rods perfectly accorded to the targeted taper pattern. Upon once having reached the accordance of the two through the repetition of the temperature pattern correction step based on the dimensional data, simple repetition of the taper formation cycle or the repetition of the taper formation cycle aided by the heating regulation as well as the cooling control based on the fixed or finally or finally corrected temperature pattern becomes practicable, with a result of doing away the correction of the temperature pattern and consequently ceasing the measuring of the dimensional data.

This invention is by no means limited to those examples or embodiments described above, but various modifications and alterations may be made for those skilled in the art within the spirit and scope of this invention.

The metallic material made into tapered rods is usually in a wire state, but it may be a rod member, a hollow pipe member. As to the shape of the material, rectangular, square, etc. in section are all permissible; as to the species of the material non-ferrous metals are permissible besides the usually employed steel.

The tapered rods according to this invention has a variety of uses, besides the use as tapered coil springs, such as for antennas, ski stocks if the material is of hollow, lamp posts, etc.

Some examples of this invention will be described hereunder for further clarifying the concrete features of this invention, by which this invention is never restricted nor bound, as a matter of course.

EXAMPLE 1

Figure 9:
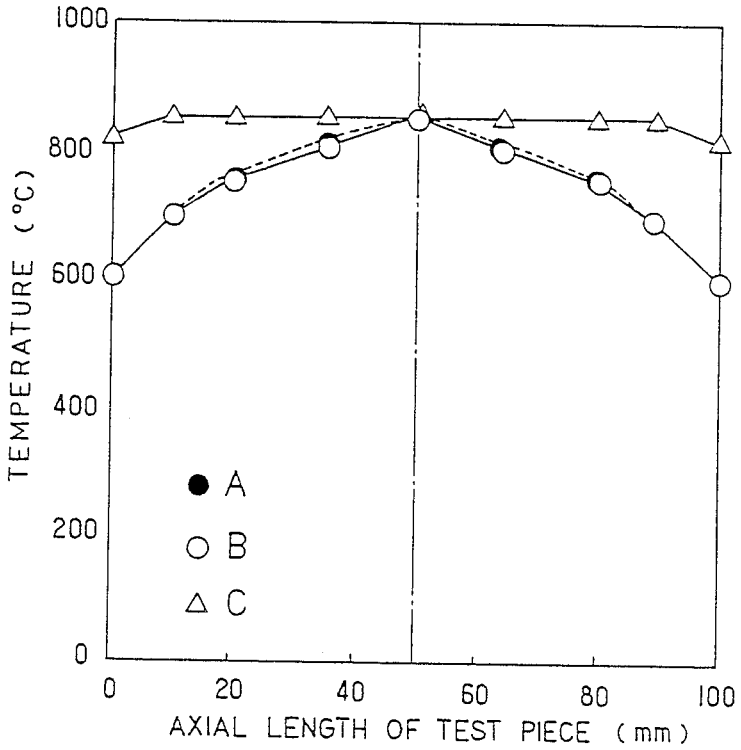
FIG. 9, FIG. 11, and FIG. 13 are respectively a graph for showing temperature distribution on test pieces according to Example 1, 2, and 3 before the pulling operation.
Figure 10:
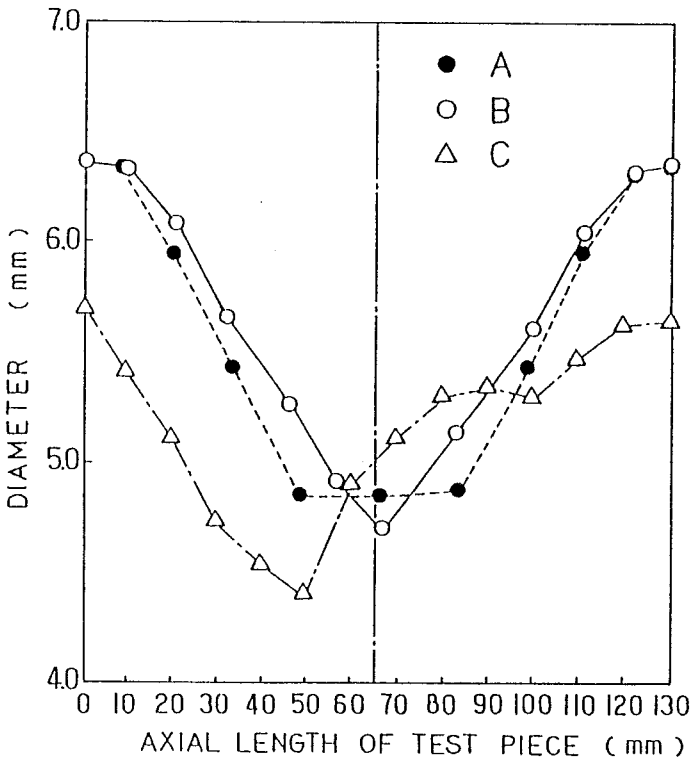
FIG. 10, FIG. 12, and FIG. 14 are respectively a graph for showing diameter distribution on test pieces according to Example 1, 2, and 3 after the pulling operation.

Test pieces (round bars) A and B of steel material SAE 9254 at room temperature, whose diameter was 6.35 mm and length 170 mm, were grasped on either end by a water cooling chuck leaving the heatable area approx. 100 mm inbetween. Direct resistance heating was made in both pieces so that the middle portion thereof might be heated up to 850° C.±5° C. Temperature distribution at that time is shown in FIG. 9. The piece A which was imparted such a temperature distribution was applied tensile force at an average rate of strain 10%/sec under the pulling speed of 50 mm/sec, and the piece B under the same condition of the temperature distribution was applied tensile force at an average rate of strain 100%/sec under the pulling speed of 100 mm/sec. Result of taper formation on both pieces are shown in FIG. 10.

As can be seen in two graphs, both pieces A and B which had been heated to form a temperature gradient were stretched or elongated by the axial pulling action at the validly affected distance from 100 mm up to 130 mm. A taper having the minimum diametered portion substantially in the middle thereof was formed, with a diameter continuously increasing towards either end in both pieces. The diameter in the middle of both pieces A, B were respectively 4.83 mm, wherein rate of reduction was 42.1%, and 4.70 mm wherein rate of reduction 45.2%.

For the purpose of comparison another test piece (round bar) C of the same steel material was heated so as to be of uniform temperature in the axial direction distribution for being pulled axially at an average rate of strain 100%/sec. at a pulling speed of 100 mm/sec, as shown in FIG. 9. It was turned out, as can be seen in FIG. 10, that the minimum diameter portion did not fall in the middle portion of the piece, the diameter did not continuously diminish, and a local necking took place.

EXAMPLE 2

Figure 11:
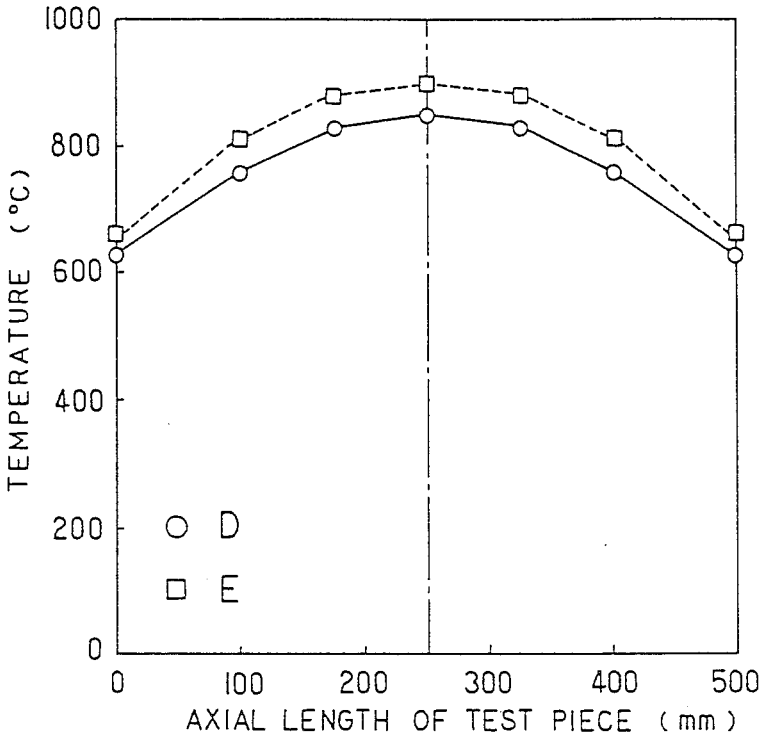
Figure 12:
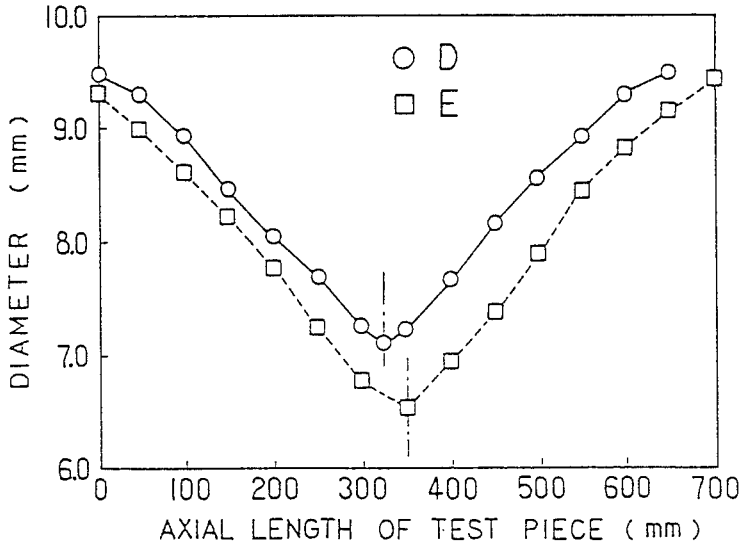
Figure 14:
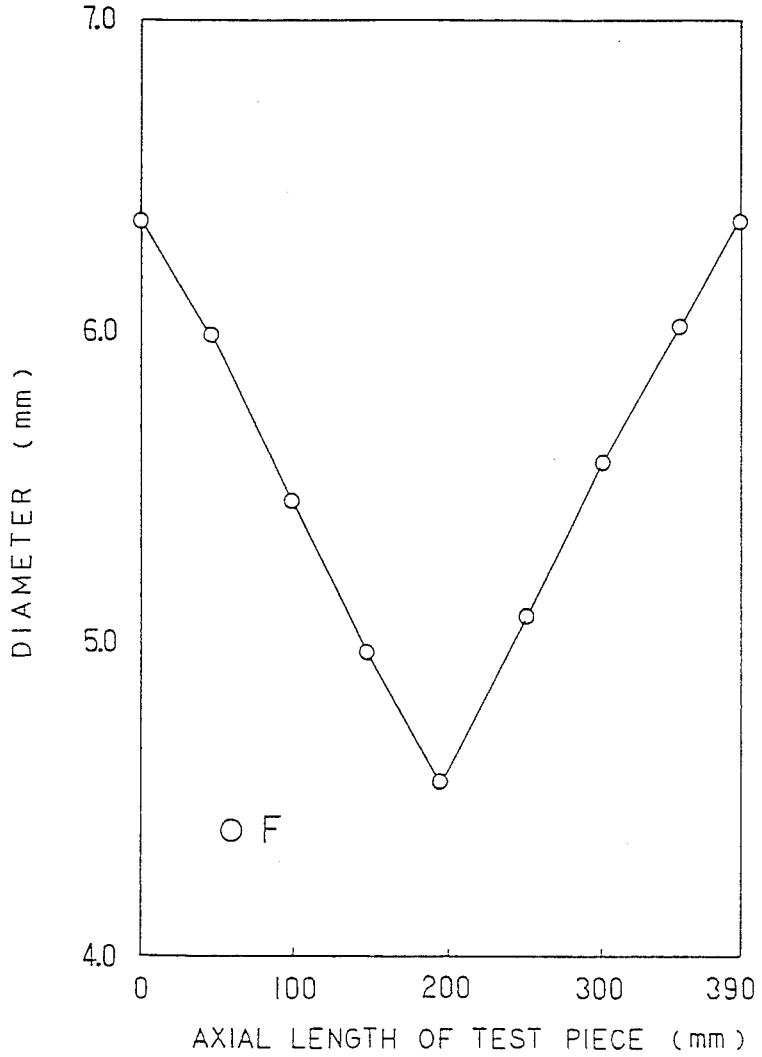

A test piece D of JIS SUP 7 steel rod at room temperature, having a diameter of 9.50 mm and a length of 700 mm, was chucked at either end by a water cooling chuck for being heated by current running at the valid heatable area of 500 mm up to form a temperature gradient pattern of 850° C. in the middle and about 620° C. on either end. The resultant temperature distribution is shown in FIG. 11. Application of tensile force in this situation to the piece at an average rate of strain 50%/sec, at a pulling speed of 250 mm/sec, resulted in elongation of the inter-chuck distance of the piece D by 150 mm, i.e., from 500 mm to 650 mm. A taper, having the minimum diametered portion in the middle, was formed, with the diameter being gradually increased towards either end. The diameter in the central portion was 7.1 mm and the rate of reduction observed there was 44.1%.

On the other hand, a test piece E of steel rod of JIS SUP 7 at room temperature, having a diameter of 9.50 mm and a length of 900 mm, was chucked by a water cooling chuck and applied high-frequency induction heating, with coil individually different in diameter so as to form a temperature gradient pattern along the heatable area of 500 mm, wherein the temperature in the central portion being 900° C.±5° C. and that on either end portion 650° C. The then temperature distribution was in such a state as shown in FIG. 11. When afterwards tensile force was applied to the piece E in the axial direction, an average rate of strain was 60%/sec and speed of pulling 300 mm/sec. The piece E which possessed the inter-chuck distance of 500 mm was elongated to 700 mm, and the formed taper had the minimum diametered portion in the central portion and a continuously diminishing diameter. The diameter of the piece E in the central portion was 6.45 mm and the then rate of reduction was 53.0%.

EXAMPLE 3

Figure 13:
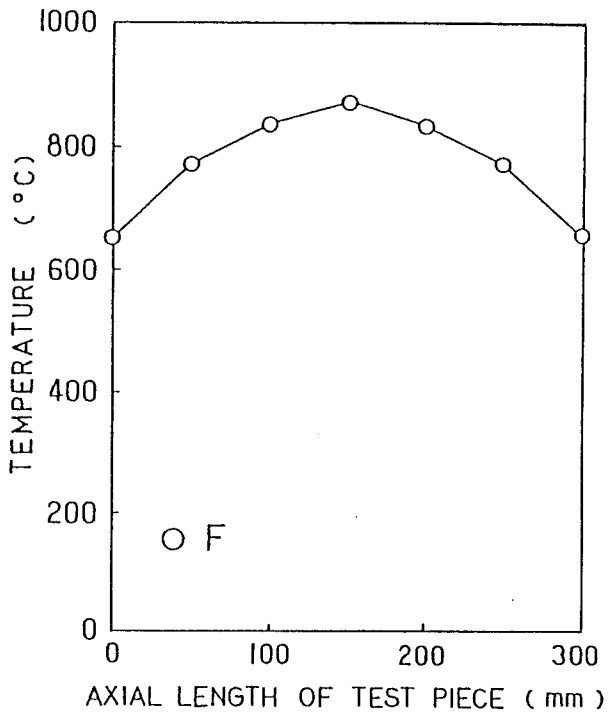

Another test piece F of steel rod SAE 9254 in a high temperature, immediately after a hot processing, whose diameter being 6.35 mm and length 450 mm, was grasped by a water cooling chuck for being heated by gas burning so as to form a temperature gradient pattern, which was 870° C. in the central portion and approx. 650° C. on either end, with temperature inbetween being gradually decreased. Then the temperature distribution is shown in FIG. 13. Axial tensile force applied afterwards with an average rate of strain 50%/sec at a pulling speed of 150 mm/sec showed an elongation of the inter-chuck distance of 300 mm up to 390 mm. In the formed taper the minimum diametered portion was located substantially in the middle thereof and the diameter was continuously decreased towards the middle. The diameter in the central portion of the piece F was 4.55 mm and the rate of reduction observed there was 48.9%.

EXAMPLE 4

A test piece (rod) of steel containing C: 0.61%, Si: 2.05%, Mn: 0.81%, and Cr: 0.11% obtained by rolling and drawing, with a diameter of 6.35 mm, was chucked at either end by a water cooling chuck. The piece was heated by directly current flowing, while simultaneously employing a plurality of air cooling means, individually different in the amount of blowing air, arranged in the axial direction of the test piece, so as to form a mountain like temperature gradient pattern along the inter-chuck distance of 200 mm, with a peak in the central portion of 850° C.

The piece of steel having the above-mentioned temperature gradient pattern was deformed afterwards by pulling while varying the rate of strain $\dot{\epsilon}$ in the central minimum diametered portion. The maximum reduced ration under uniform deformation at each rate of strain are shown in TABLE 1 as the resultant data. The maximum reduced ratio under uniform deformation (%) signifies here the amount of deformation until immediately before the occurring of a necking as a premonition to a breakage, that is $(A_o\text{-}A)\times 100/A_o$, i.e., (sectional area of the material-sectional area of the minimum diametered portion)×100/sectional area of the material. The numerical data in TABLE 1 is shown in FIG. 15 as a graph.

Figure 15:
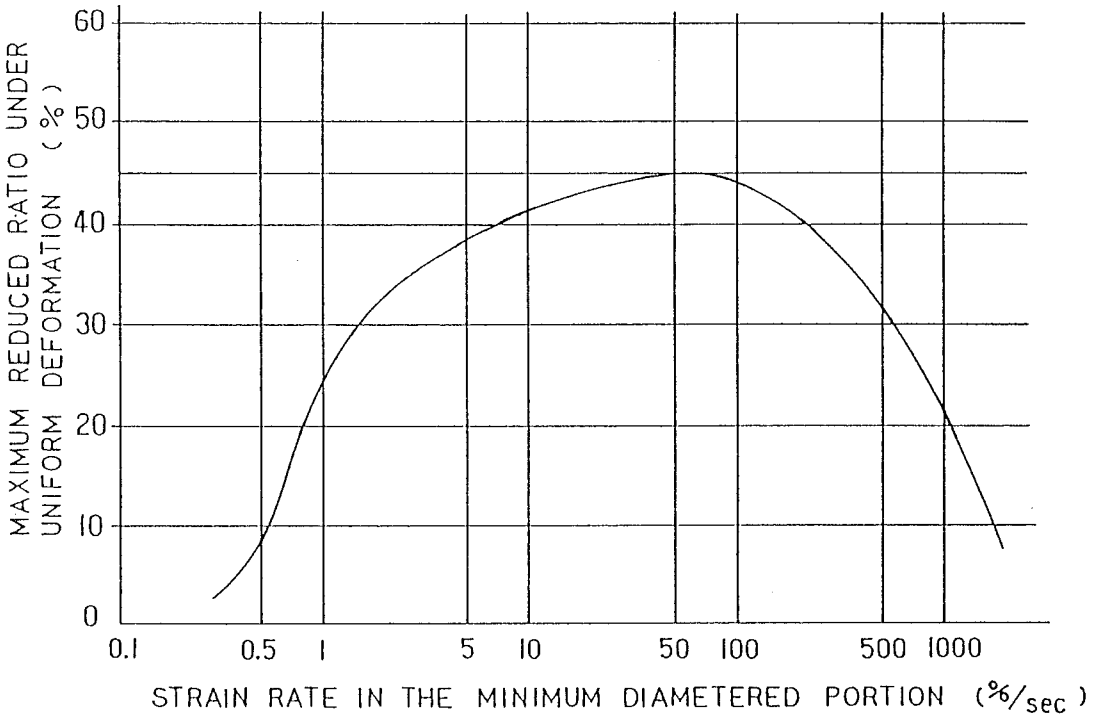
FIG. 15 is a graph for showing relation observed in Example 4 between the rate of strain (deformation) in the minimum section of the bar and the maximum reduced ratio under uniform deformation.

As can be understood from TABLE 1 and FIG. 15, the maximum reduced ratio under uniform deformation (called "MR ratio" thereafter) is large in the range of the rate of strain by processing 0.5–1000%/sec, and even the largest possible portion thereof exisits in this range.

By carrying out the deformation by pulling within such a range containing the MR ratio, processing of an aimed taper form turns out easier, because it will economize the processing labour amount.

TABLE 1

| NO. | Rate of strain in processing $\dot{\epsilon}$ | MR ratio (%) |
|---|---|---|
| 1 | 0.14 | 4.3 |
| 2 | 0.52 | 8.2 |
| 3 | 1.02 | 25.1 |
| 4 | 4.55 | 36.2 |
| 5 | 39.2 | 46.5 |
| 6 | 107 | 43.1 |
| 7 | 510 | 31.8 |
| 8 | 1725 | 16.5 |

EXAMPLE 5

A test piece of steel material in wire state containing the various chemical components shown in TABLE 2, obtained by spheroidizing annealing and drawing was heated by the mode described in EXAMPLE 4, the maximum heating temperature there is shown in TABLE 3, until a predetermined temperature gradient pattern was achieved, before it was deformed by pulling in the mode described in EXAMPLE 4 at the rate of strain ($\dot{\epsilon}$) shown in TABLE 3. The resultant data of the MR ratio (%) is parallelly shown in TABLE 3. In any case of steel material an excellent MR ratio was well proved.

TABLE 2

| No. | Chemical component (%) | | | | |
|---|---|---|---|---|---|
| | C | Si | Mn | Cr | Others |
| 9 | 1.07 | 0.28 | 0.52 | — | — |
| 10 | 0.51 | 0.25 | 0.77 | 0.96 | 0.19 V |
| 11 | 0.54 | 0.29 | 0.71 | 0.91 | 0.92 V |
| 12 | 0.37 | 1.12 | 0.31 | 4.92 | 0.98 Mo, 0.42 V |
| 13 | 0.58 | 2.45 | 0.77 | 0.01 | — |
| 14 | 0.62 | 0.71 | 1.98 | 0.02 | — |
| 15 | 0.55 | 0.85 | 1.15 | 0.03 | 0.85 Cu |
| 16 | 0.36 | 0.35 | 0.82 | 1.55 | 2.98 Ni, 0.35 Mo |
| 17 | 0.61 | 0.31 | 0.89 | 0.91 | 0.0029 B |
| 18 | 0.58 | 1.20 | 0.75 | 0.21 | 0.095 Al |
| 19 | 0.42 | 0.31 | 0.55 | 1.02 | 0.46 Ti |
| 20 | 0.92 | 0.33 | 1.12 | 0.49 | 0.49 W |
| 21 | 0.49 | 0.38 | 1.51 | 0.55 | 0.38 Nb |
| 22 | 0.51 | 0.39 | 1.49 | 0.73 | 0.44 Zr |
| 23 | 0.62 | 0.35 | 1.20 | 0.75 | 0.49 Ta |
| 24 | 0.51 | 0.11 | 0.95 | 1.00 | 0.33 $H_f$ |

TABLE 3

| NO. | Material Diameter (mm) | Valid distance to be heated (mm) | Maximum heating temperature (°C.) | Rate of strain in the minimum diametered portion (%/sec) | MR ratio (%) |
|---|---|---|---|---|---|
| 9 | 10.0 | 800 | 830 | 23.5 | 42.1 |
| 10 | 12.7 | 1000 | 870 | 30.1 | 39.1 |
| 11 | 12.7 | 1000 | 980 | 35.5 | 35.9 |
| 12 | 6.35 | 200 | 930 | 20.3 | 25.2 |
| 13 | 12.0 | 1350 | 850 | 215 | 38.8 |
| 14 | 10.0 | 800 | 850 | 95.2 | 41.1 |
| 15 | 6.35 | 200 | 770 | 18.5 | 33.2 |
| 16 | 10.0 | 800 | 850 | 73.5 | 47.2 |
| 17 | 12.0 | 1000 | 830 | 153 | 37.5 |
| 18 | 10.0 | 800 | 770 | 55.2 | 29.0 |
| 19 | 6.35 | 200 | 770 | 39.0 | 33.1 |
| 20 | 6.35 | 200 | 940 | 83.2 | 40.6 |
| 21 | 6.35 | 200 | 980 | 650 | 25.1 |
| 22 | 6.35 | 200 | 980 | 353 | 30.7 |
| 23 | 6.35 | 200 | 850 | 95.2 | 22.2 |
| 24 | 6.35 | 200 | 900 | 77.5 | 42.5 |

EXAMPLE 6

A piece of steel rod containing C:0.61%, Si:1.94%, and M:0.81%, having a diameter of 6.35 mm, obtained by rolling and drawing was grasped on either end by a water cooling chuck for being heated by the direct resistance heating method, accompanied by a plurality of cooling means individually different in the amount of air blowing and arranged in each position in the axial direction of the piece so as to form a mountain like temperature gradient pattern along the heatable distance between the chucks of 200 mm wherein the peak of the pattern was 850° C.

After the heating the piece with the above-mentioned temperature gradient pattern was deformed by pulling, at a gradually decreasing crosshead speed from high to low as shown in FIG. 16 (*b*). The varying trend of the rate of strain from the initial speed to the final speed is shown in FIG. 16 (*a*).

As can be seen in FIG. 16 (*a*) the MR ratio, i.e., rate of reduction could be made large by the gradual decrease of the rate of strain. Deformation by pulling in the range of such a large MR ratio made the formation of an aimed taper quite easy, because it diminishes the labour hour or labour amount. As can be observed in the figure the larger the rate of variation from the initial speed to the final speed becomes, the larger MR ratio is obtained.

In a case wherein the pulling was carried out at a constant rate of strain 100%/sec, the obtained MR ratio was only 26% or so.

In this Example every piece of tapered rod obtained under a gradually decreasing speed could get a parallel portion with a constant diameter.

EXAMPLE 7

Figure 17A:
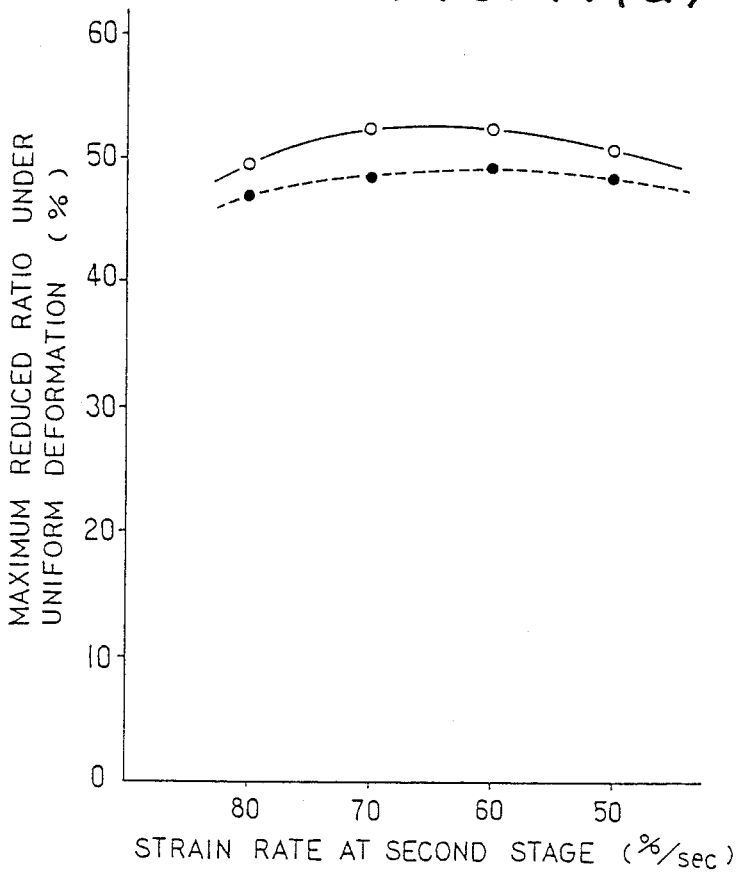
FIG. 17 (*a*) and (*b*) are respectively a graph for showing the result observed in Example 7 of two-stepped tensile force pulling and a graph for showing the pattern of the two-stepped pulling.
Figure 17B:
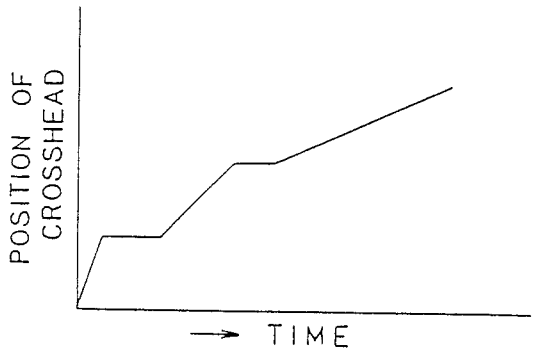
Figure 18A:
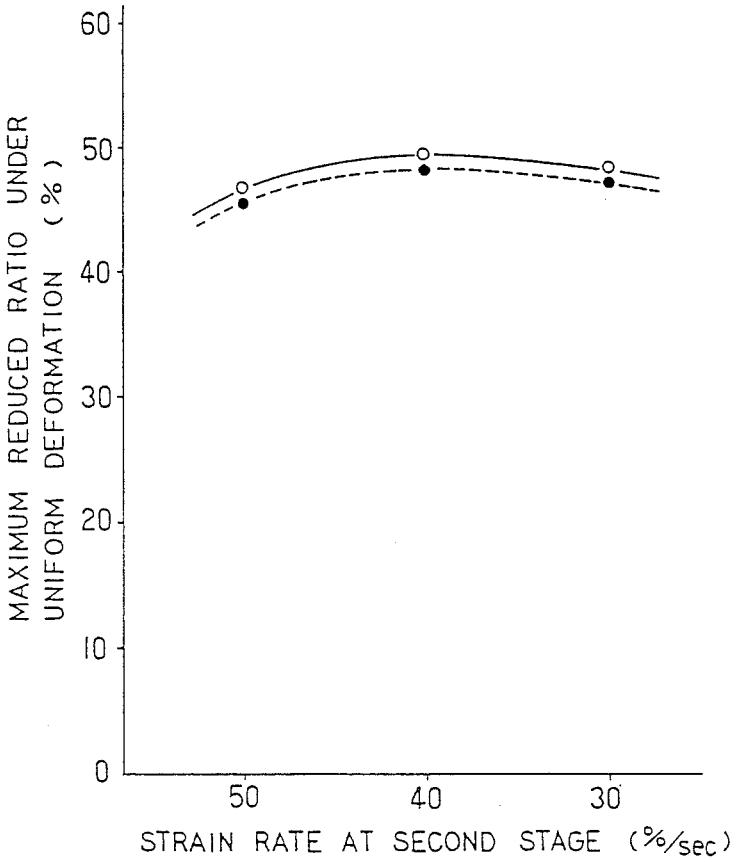
FIG. 18 (*a*) and (*b*) are respectively a graph for showing the result observed in Example 8 of three-stepped tensile force pulling and a graph for showing the pattern of the three-stepped pulling.
Figure 18B:
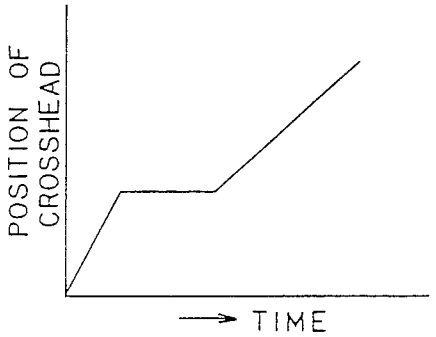

On a piece which had been imparted the temperature gradient pattern in EXAMPLE 6 was applied a two-stepped pulling as shown in FIG. 17 (*a*) and (*b*).

As one of those two-stepped pulling modes, a test was made by setting a first stage of 100%/sec rate of strain for five seconds, than as a second stage 50, 40, and 30%/sec rates of strain were respectively performed one by one. The resultant MR ratios are plotted in FIG. 17 (*a*) as circled marks.

Another of the two-stepped pulling modes, a test was made wherein the first stage rate of strain was set at 70%/sec for being held for five seconds, and the second stage rate of strain was set at 50, 40, and 30%/sec respectively in order. The resultant MR ratios are shown in FIG. 17 (*a*) with solid marks of black circle.

In single-stepped pulling tests on a same piece with the rate of strain respectively 100%/sec and 70%/sec, which were performed for the purpose of comparison, the resultant MR ratios were respectively 26% and 22%.

As can be understood from this result, the two-stepped pulling mode is effective in improving the MR ratio, and further the higher the rate of strain in the first stage is, the larger becomes the MR ratio.

EXAMPLE 8

A test piece of steel rod which had been imparted a predetermined temperature gradient pattern by the mode described in EXAMPLE 6 was given a three-stepped pulling operation as shown in FIG. 8 (*a*) and (*b*).

This experiment was executed specifically in two ways:

First way was

| | | |
|---|---|---|
| in the first stage, | rate of strain | 100%/sec |
| | holding time | 3 seconds |
| in the second stage, | rate of strain | 80, 70, 60, and 50%/sec |
| | holding time | 2 seconds |
| in the third stage, | rate of strain | 30%/sec |

Second way was different from the first way only in the rate of strain applied in the third stage, which was changed to 10%/sec.

The resultant data were plotted in the graph in FIG. 8 (*a*), the circled marks being the data of the former way and the solid marks of black circle being the data of the latter way experiment.

What is observed in the graph of FIG. 8 (*a*) is that the three-stepped pulling mode greatly improved the MR ratio, and that the ratio is larger when the rate of strain in the third stage is larger.

What is claimed is

1. A tapered coil spring formed of a steel wire member consisting essentially of carbon, silicon, manganese, chromium, niobium and iron in the amounts of 0.35%–1.10% by weight of carbon, not more than 2.5% by weight of silicon, not more than 1.5% by weight of manganese, not more than 5.0% by weight of chromium, not more than 0.5% by weight of niobium, and the remainder of iron by being given axial tensile force while being imparted heating with a predetermined pattern of temperature gradient in the axial direction of said steel wire member so as to possess a tapered portion thereof where the diameter of said tapered wire member is varied in the axial direction thereof.

2. A tapered coil spring in accordance with claim 1, wherein said tapered portion possesses a continuously varying diametered in the axial direction of said steel wire member.

3. A tapered coil spring in accordance with claim 1, wherein said steel wire member further includes at least one element selected from the group consisting of not more that 3.0% by weight of copper, not more than 3.0% by weight nickel, not more than 1.0% by weight of molybdenum, not more than 1.0% by weight of vanadium, not more than 0.05% by weight of boron, not more than 1.0% by weight of aluminum, and not more that 0.5% by weight of titanium, zirconium, tantalum, tungsten, and hafnium.

* * * * *